United States Patent [19]

Anderson et al.

[11] Patent Number: 4,715,723

[45] Date of Patent: Dec. 29, 1987

[54] ARRANGEMENT FOR CONTROLLABLY MIXING VOLATILE MATERIALS

[75] Inventors: Roy W. Anderson, San Jose; Stephen J. Ross, Morgan Hill; Larry D. Henderson, San Jose, all of Calif.

[73] Assignee: United Technologies Corporation, Hartford, Conn.

[21] Appl. No.: 936,049

[22] Filed: Nov. 28, 1986

[51] Int. Cl.[4] ..... B01F 15/00

[52] U.S. Cl. ..... 366/142; 366/301

[58] Field of Search ..... 366/142, 144, 149, 297, 366/300, 301

[56] References Cited

U.S. PATENT DOCUMENTS 3,447,201 6/1969 Seanor et al. ..... 366/142 X
3,951,386 4/1976 Small et al. ..... 366/142
4,042,219 8/1977 Terry ..... 366/142
4,443,110 4/1984 den Otter ..... 366/144 X

*Primary Examiner*—David Werner
*Attorney, Agent, or Firm*—A. Dean Olson

[57] ABSTRACT

A mixing arrangement (113) for mixing volatile materials (118, 119) in a mixing container (114), including mixing blades (118, 119) and a drive mechanism (117), at least one of said blades (118, 119) holding a temperature detection arrangement (250) effective for detecting bulk temperature levels in said materials during mixing operation and thereby enabling control of the velocity of the mixing blades (118, 119) in the materials being mixed, said temperature detection arrangement being effective for external communication of information developed during detection operation.

5 Claims, 1 Drawing Figure

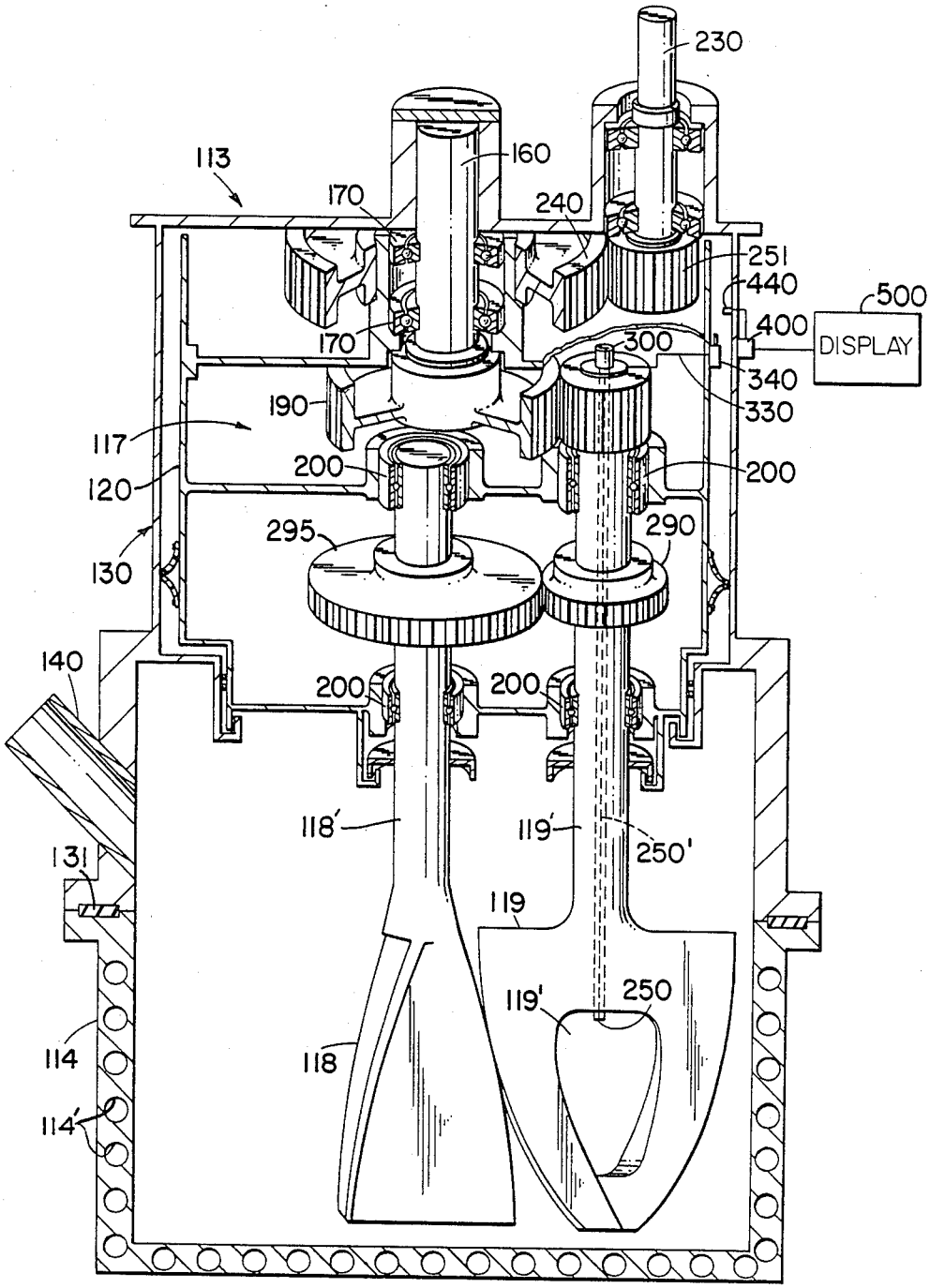
230
113
160
170
240
251
440
500
400
DISPLAY
170
300
340
330
190
117
200
200
120
295
290
130
140
200
200
118'
119'
250'
131
119
119'
250
114
118
114'

ARRANGEMENT FOR CONTROLLABLY MIXING VOLATILE MATERIALS

DESCRIPTION

1. Technical Field

This invention is directed toward the technology of mixing volatile or potentially volatile materials controllably in accordance with the heat generated during mixing operation.

2. Background Art

The mixing of volatile and potentially volatile materials is a highly sensitive operation, involving the careful monitoring of the temperature of the mixed materials during mixing operation to prevent the mixture from becoming overheated and exploding.

By mixing the particular materials too rapidly, frictional forces are developed, which tend to cause overheating. Thus, it becomes necessary to slow the mixing to permit heat removal at a rate equal to or greater than the production of the new heat being generated during mixing. To accomplish control of the mixing speed in response to overheating, an arrangement for temperature sensing becomes necessary.

The kinds of materials which may be mixed in such kinds of operation vary in characteristics from hazardous and very sensitive to nonhazardous and insensitive. One such material is nitroglycerin (i.e., glyceryl trinitrate), which is a viscous pale yellow oil and very sensitive to shock. Another material is polyethylene glycol, a flamable clear viscous liquid polymer which can be used as a binder. Additionally, used in mixing is N-methyl-paranitroaniline, a stabilizer used to prolong shelf life of given mixtures, but nonetheless toxic and flamable. Nitrocellulose is another mixer material, which in its dry state is extremely fire hazardous and potentially explosive. Further, aluminum powder can be mixed as a propellent fuel. It can burn or explode if ignited while suspended in air. The oxidizer ammonium perchlorate, used to adjust and control burn rates is hazardous in its contaminating effect upon wax, oil, grease or paper. Further, the mixing agent cyclo tetramethylene tetranitramine (HMX) can be employed. It ranks below nitroglycerin in energy as a propellant. HMX, in its dry form, is a high exploxive, sensitive to impact, friction and electrostatic discharge.

A requirement of temperature sensing of the mixture is that it should accurately measure bulk temperature within the mixture, which is representative not merely of a single location within the mixture, but of a generalized temperature quantity indicative of heat actually contained within the mixture at a given time.

A brief review of a known mixing apparatus for mixing volatile mixtures is of interest. One such apparatus conducts mixing by insertion of one or more mixing blades into the mixture at a predetermined level and rotating at a selected rate. Accordingly, the heat generated will of course be a function of blade rotational velocity.

DISCLOSURE OF INVENTION

According to the invention herein, a temperature sensing arrangement is established in a mixer arrangement including at least a single mixing blade for insertion into a volatile mixture to be stirred, in order to monitor bulk temperature levels in the material being mixed, thereby ensuring accurate overall temperature measurements indicative of bulk temperature conditions within the mixer arrangement. In particular, according to the invention, temperature is detected with a suitable temperature detection element such as for example a resistance temperature detection (RTD) element, effective for producing an electrical signal in an electric wire connected to the temperature detection element, which is indicative of temperature sensed by the temperature detection element. The electric wire extends along and through the axis or centerline of the of the mixer blade staff and communicates with a radially extending wire through a slip ring. The radially extending wire is in turn connected to a radio transmitter effective for broadcasting the nature of the communicated temperature signal to a receiving antenna and receiver in the outer case of the mixer arrangement.

Other features and advantages will be apparent from the specification and claims and from the accompanying drawing which illustrates an embodiment of the invention.

BRIEF DESCRIPTION OF DRAWING

FIG. 1 shows the mixing apparatus according to the invention herein including mixing blades and staff and the temperature sensing arrangement addressed herein.

BEST MODE FOR CARRYING OUT THE INVENTION

According to the invention, FIG. 1 shows the mixing arrangement or mixer 113 according to the invention herein. Mixer 113 includes stationary housing 130.

The mixer 113 in particular defines a container 114 for holding volatile materials to be mixed. The container 114 is cooled through cooling holes 114' through which a suitable cooling fluid can be circulated to remove heat from the outer regions of the materials being mixed in container 114.

Mounted over container 114 is a rotatable drive mechanism 117 for spinning respective mixing blades 118 and 119 within the selected volatile materials to be mixed. Each mixing blade 118,119 has an associated staff, respectively 118' and 119'. The blades 118 and 119 and drive mechanism 117 are mounted within rotatable housing 120 as shown.

Container 114 is sealed against stationary housing 113' by suitable circular seals 131. The volatile or potentially volatile materials to be mixed can be introduced into container 114 through chute 140 in stationary housing 130 from an external source (not shown), thereby preventing loss or escape of any of the selected materials to be mixed.

Mounted in stationary housing 130 is stationary shaft 160 on which rotating housing 120 hangs with bearings 170. Also fixedly coupled to shaft 160 is stationary gear 190, which provides a gear surface effective for causing blade 119 to turn when rotatable housing 120 rotates about shaft 160.

Each of blades 118 and 119 hangs in rotatable housing 120 on respective suitable bearing structures 200. Additionally, drive shaft 230 turns gear 240 through gear 25 fixedly mounted on shaft 230. As a result, gear 240 thereby causes rotatable housing 120 to spin in relationship therewith. Finally, gear 290 causes gear 295 to turn, whereby blade 118 rotates in coordination with blade 119.

As shown, blade 119 defines a central cavity 119' through which the mixture in container 114 can pass during mixing operation.

According to the invention herein, a temperature detection element 250 such as a resistance temperature detection (RTD) element for example, is installed in blade 119 and particularly at the upper side of central cavity 119' defined by blade 119 to measure bulk temperature conditions as blade 119 travels through container 114. The temperature detection element 250 can be mounted elsewhere on blade 119, but preferably along the centerline thereof, in accordance with the invention.

The temperature detection element 250 moreover communicates electrically along a line 250' passing through an axial aperture along the centerline of shaft 119' of blade 119 extending from the temperature detection element 250 toward the upper end of staff 119'. According to one version, the temperature detection element 250 accordingly communicates electrically with slip ring 300 through line 250' and then in turn communicates with radial wire 330 to an internal transmitter 340 mounted on rotatable housing 120 for communication with externally mounted receiver 400 including antenna 440 inserted within stationary housing 130 to enable radio frequency communication. The temperature information thus developed can be shown on a suitable external display 500 for monitoring by designated personnel (not shown).

Accordingly, the mixer 113 cooperates by rotatable housing 120 turning at a controlled rate of angular velocity within stationary housing 113'. This rotation in turn spins first blade 119 at a proportional rate and also blade 118 therewith. The heat generated by this mixing departs through container 114, subject to the cooling effect of fluid passing through cooling holes 114'. Temperature detection element 250 thus measures bulk temperature actually within the container 114 unaffected by any fluctuations in heat removal in the region of the surface of the container 114 itself. An electrical signal representative thereof then travel through the staff 119' of blade 119 to the slip ring on rotatable housing 120, and then radially outward for radio communication to the display 500.

It should be understood that the invention is not limited to the particular embodiments shown and described herein, but that various changes and modifications may be made without departing from the spirit and scope of this novel concept as defined by the following claims.

We claim:

1. A mixing arrangement for mixing volatile materials comprising containment means for holding the materials to be mixed, said containment means defining holes for circulation of cooling fluid, first blade means for mixing said materials and drive means for turning said blade means to conduct mixing operation with respect to said materials, said mixing apparatus characterized in that said first blade means includes temperature detection means for monitoring bulk temperature levels within the materials being mixed and an external display arrangement for temperature levels detected by said temperature detection means and radio communication with said drive means.

2. The mixing arrangement of claim 1, wherein said first blade means defines an axial central aperture for enabling external communication with said temperature detection means.

3. The mixing arrangement of claim 2, wherein said temperature detection means is effective in development of an electrical signal representative of temperature levels detected by said temperature detection means.

4. The mixing arrangement of claim 1, wherein said temperature detection means is mounted along the central axis of said first blade means.

5. The mixing arrangement of claim 1, wherein said drive means rotates at a selectable speed subject to reduction in view of temperature levels monitored by said temperature sensing means.

* * * * *